US006585387B1

(12) United States Patent
Lee

(10) Patent No.: US 6,585,387 B1
(45) Date of Patent: Jul. 1, 2003

(54) HANGING BUBBLE LAMP

(76) Inventor: Chun Teng Lee, No. 71, Lane 17, Chau Hu Street, Hsinchu City (TW)

( * ) Notice: Subject to any disclaimer, the term of this patent is extended or adjusted under 35 U.S.C. 154(b) by 0 days.

(21) Appl. No.: 10/020,181

(22) Filed: Dec. 18, 2001

(51) Int. Cl.[7] ..... F21V 33/00
(52) U.S. Cl. ..... 362/96; 362/101; 362/806
(58) Field of Search ..... 362/96, 101, 806

(56) References Cited

U.S. PATENT DOCUMENTS 2,468,283 A * 4/1949 Abramson ..... 40/406
4,020,337 A * 4/1977 Chatten ..... 362/234

* cited by examiner

*Primary Examiner*—Sandra O'Shea
*Assistant Examiner*—Guiyoung Lee
(74) *Attorney, Agent, or Firm*—Rosenberg, Klein & Lee

(57) ABSTRACT

The present invention relates to a hanging bubble lamp, which includes a conductive receiver with a sleeve to receive a water tube therein and two conductive wires extended downward. The ends of the tube and the sleeve are engaged within a holder, which has two conductive slices to electrically contact with the conductive wires and a heating bulb in a connector in the holder. By used of the conductive, the water tube of the bubble lamp will be kept in a hanging position for providing a special decorative effect.

3 Claims, 4 Drawing Sheets

HANGING BUBBLE LAMP

BACKGROUND OF THE INVENTION

A conventional bubble lamp, as shown in FIG. 1, includes a holder (1) with an inner bulb (2) and a water tube (3). When the bulb (2) is electrically conducted to light, it produces heat at the same time. The heat will heat water in the tube (3) and when the temperature of water raises to a certain degree, some known medium (31) in the tube (3) will produce bubbles (32) to provide a predicted decorative effect. The prior bubble lamp is always used at a standing position. It can not be used in hanging as shown in FIG. 2, since water will fall at bottom in the tube (3) without contacting with medium (31). There will not be any bubble produced for decoration.

Accordingly, the primary object of the invention is to provide a hanging bubble lamp, which can be hanged by a conductive receiver for providing the water tube having bubbles as in use to display its special decorative purpose. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
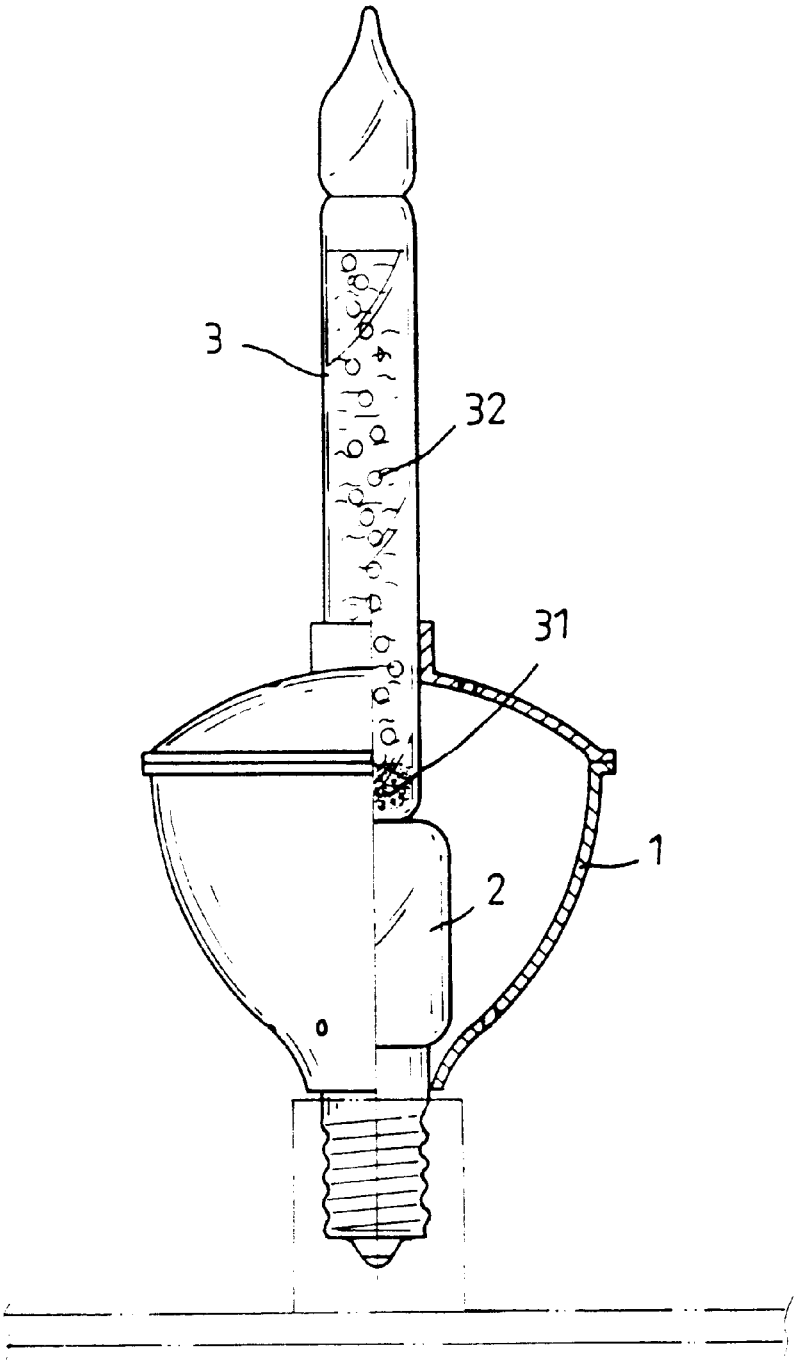
F I G. 1 (prior art)
FIG. 1 is a semi cross-sectional plan view showing a known bubble lamp in standing position.
Figure 2:
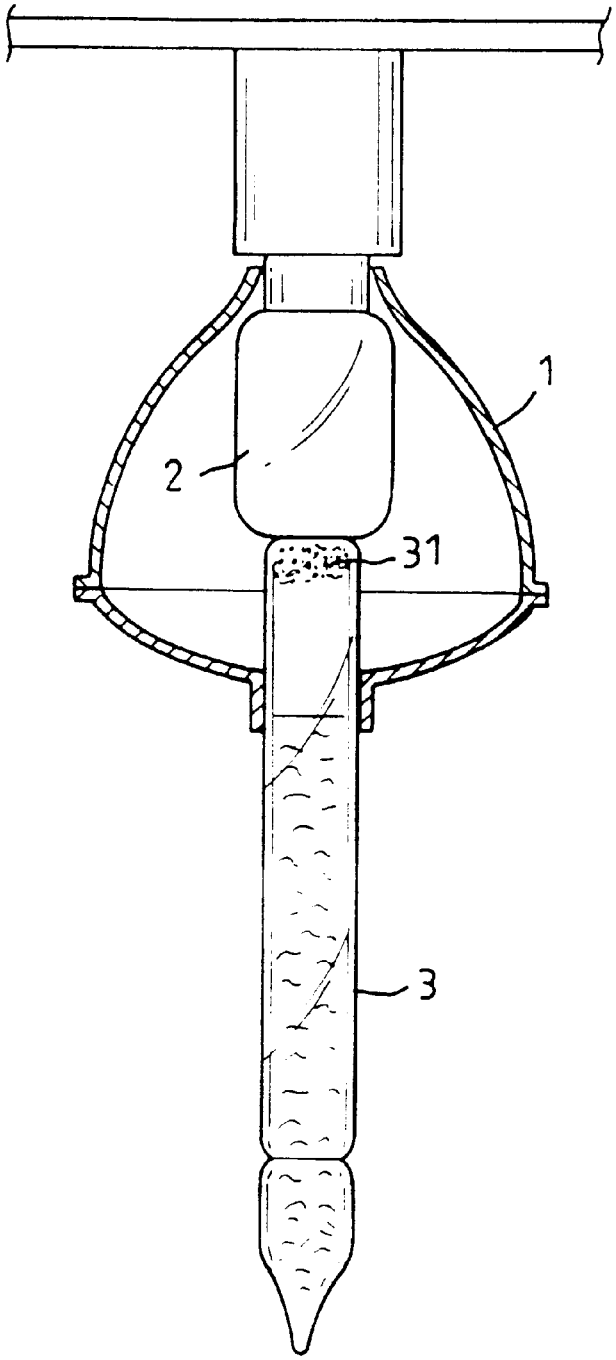
FIG. 2 (prior art)
FIG. 2 is a partly cross-sectional plan view showing the known bubble lamp of FIG. 1 in hanging position.
Figure 3:
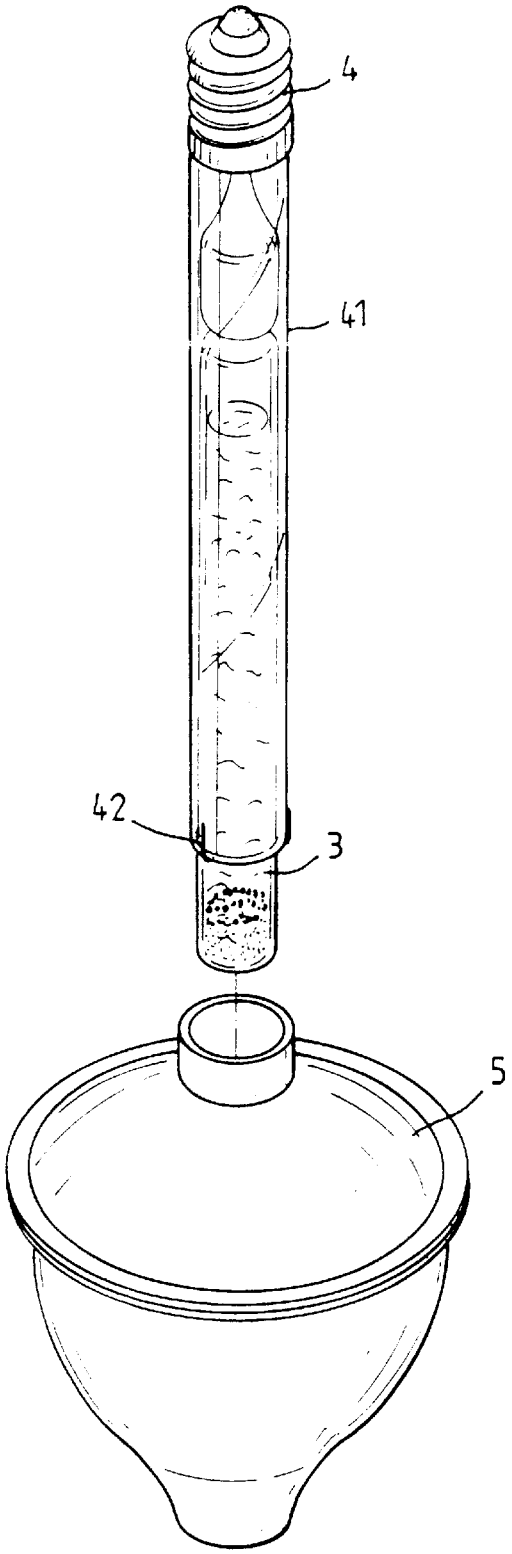
FIG. 3 is an exploded perspective view showing a hanging bubble lamp according to the present invention.
Figure 4:
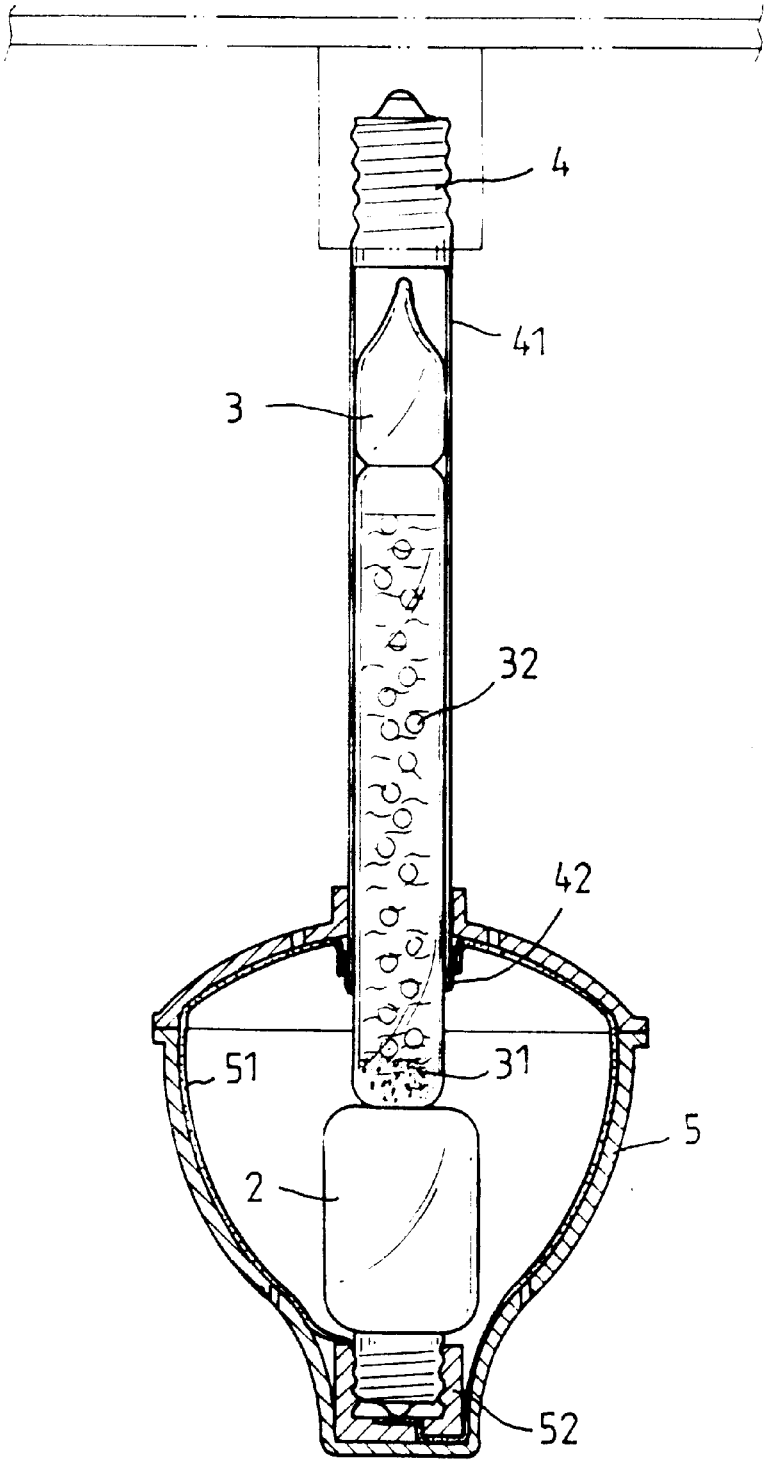
FIG. 4 is a cross-sectional plan view showing an exemplary embodiment of an assembled hanging lamp according to the present invention.

Please refer to FIGS. 3 and 4, the present invention relates to a hanging bubble lamp including a prior water tube (3) and a known heating bulb (2). The characteristic of the present invention includes an improved holder (5) and conductive receiver (4). The conductive receiver (4) has a sleeve (41) to receive the tube (3) and has two conductive wires (42) extended downward with folded end. The lower ends of the tube (3) and the receiver (4) are engaged with the holder (5). The holder (5) is provided with two conductive slices (51), each of which is respectively extended to a different pole of a bulb connector (52) in the holder (5) and is electrically contacted with the heating bulb (2) engaged with the connector (52).

In use, the conductive receiver (4) can be connected with a connector on a lighting string to provide the water tube (3) being at a hanging position. The conductive wire (42) and the conductive slice (51) provide electrical connection for bulb (2) to be heated to heat water in the tube (3) till bubbles (32) are produced to reach the object of the present invention.

Accordingly, the present invention provides an invented structure with improvement, which keeps the bubble lamp to be used in hanging position to produce bubbles for decoration as a known one. It obviously gains the utility and novelty for patent and is thus applied.

What is claimed is:

1. A hanging bubble lamp comprising:

(a) a tube having distal first and second end portions, said tube containing a liquid;

(b) a holder coupled to said first end portion of said tube, said holder including a connector and a heating bulb electrically connected to said connector, said heating bulb being disposed external to said tube; and, (c) a conductive receiver for suspended coupling to an electric socket, said conductive receiver including a sleeve and pair of conductive members extending therefrom, said sleeve receiving therein at least said second end portion of said tube and coupling to said holder, said conductive members extending along said sleeve to couple electrically to said connector.

2. The hanging bubble lamp as recited in claim 1 wherein said holder includes a pair of conductive slices extending from said connector, said conductive slices conductively engaging respective ones of said conductive members.

3. The hanging bubble lamp as recited in claim 1 wherein said first and second end portions of said tube respectively form lower and upper end portions therefor.

* * * * *